US010378780B2

(12) United States Patent
Kurosu

(10) Patent No.: US 10,378,780 B2
(45) Date of Patent: Aug. 13, 2019

(54) APPARATUS AND METHOD FOR CLEANING SPLIT SYSTEM AIR CONDITIONERS

(71) Applicant: The Air Center LLC, Ewa Beach, HI (US)

(72) Inventor: Alan N. Kurosu, Ewa Beach, HI (US)

(73) Assignee: The Air Center LLC, Ewa Beach, HI (US)

( * ) Notice: Subject to any disclaimer, the term of this patent is extended or adjusted under 35 U.S.C. 154(b) by 93 days.

(21) Appl. No.: 15/413,424

(22) Filed: Jan. 24, 2017

(65) Prior Publication Data

US 2018/0209684 A1 Jul. 26, 2018

(51) Int. Cl.

| | |
|---|---|
| ***F24F 1/0007*** | (2019.01) |
| ***F24F 13/22*** | (2006.01) |
| ***F24F 1/0057*** | (2019.01) |
| ***B08B 9/093*** | (2006.01) |
| ***B08B 3/02*** | (2006.01) |

(52) U.S. Cl.

CPC ..... *F24F 1/0007* (2013.01); *F24F 1/0057* (2019.02); *F24F 13/222* (2013.01); *B08B 3/02* (2013.01); *B08B 9/093* (2013.01); *F24F 2221/225* (2013.01)

(58) Field of Classification Search

CPC combination set(s) only.

See application file for complete search history.

(56) References Cited

U.S. PATENT DOCUMENTS 4,513,586 A * 4/1985 Jennings ..... F24F 1/10 248/678
4,941,901 A * 7/1990 Ramakrishnan ..... F24F 13/22 62/262
5,191,770 A 3/1993 Kim
(Continued)

FOREIGN PATENT DOCUMENTS

JP 05126356 A 5/1993
JP 01222120 B2 7/1997
(Continued)

OTHER PUBLICATIONS

Quadomated, Fujitsu 15RLS2 "Heat Pump Installed, My Initial Thoughts", Jun. 2, 2013, Internethttp://www.quadomated.com/house/fujitsu-15r1s2-heat-pump-installed-my-initial-lhoughts/.

*Primary Examiner* — Douglas Lee
(74) *Attorney, Agent, or Firm* — Seth M Reiss, AAL, ALLLC

(57) ABSTRACT

An apparatus and method for cleaning split system air conditioning units. The apparatus comprises a shield functioning as a moisture barrier that sits between the wall and the AC unit and which releasably receives a drain pan that interconnects with the bottom of the shield to form a water tight seal. A flexible tube connects the bottom of the drain pan to a collection receptacle. Water and chemical sprayed into the unit to clean the unit drain through the unit, into the drain pan, through the tubing, and are collected by and can be disposed of from the receptacle. After the AC unit is cleaned, the drain pan, tubing and collection receptacle are removed leaving the area clean and dry. Kits comprising the apparatus of the invention can be sold together with new AC units or purchased separately.

19 Claims, 8 Drawing Sheets

(56) References Cited

U.S. PATENT DOCUMENTS

| | | | | |
|---|---|---|---|---|
| 8,468,648 | B1 * | 6/2013 | Smith | B08B 5/04 15/344 |
| 9,259,769 | B1 | 2/2016 | Kane et al. | |
| 2007/0144198 | A1 * | 6/2007 | Lee | F24F 13/222 62/291 |
| 2015/0059391 | A1 | 3/2015 | Montirosso | |
| 2015/0153055 | A1 * | 6/2015 | Oakner | F25D 21/14 62/126 |

FOREIGN PATENT DOCUMENTS

| | | | | |
|---|---|---|---|---|
| JP | 2001012897 | A | 1/2001 | |
| JP | 2001041685 | A | 2/2001 | |
| JP | 2012242005 | A | 12/2012 | |
| WO | WO-2012100282 | A1 * | 8/2012 | B08B 3/04 |

* cited by examiner

APPARATUS AND METHOD FOR CLEANING SPLIT SYSTEM AIR CONDITIONERS

CROSS-REFERENCE TO RELATED APPLICATIONS

There are no related patent applications.

STATEMENT REGARDING FEDERALLY SPONSORED RESEARCH

The invention described herein was not made pursuant to a government agency grant or contract. No government funds were utilized in the described invention.

FIELD OF THE INVENTION

The present invention is in the technical field of air conditioners. More particularly, the present invention describes apparatus and methods for cleaning split system air conditioning units.

BACKGROUND OF THE INVENTION

Split system air conditioners ("ACs") or mini-split system ACs are popular and efficient air conditional systems heavily employed in residential and commercial structures. These systems require regular cleanings at yearly intervals, more or less, for longevity of the system and to ensure the system is running at maximum efficiency.

Because split system air conditioners are permanently mounted into a wall, the currently available methods for cleaning are time consuming, messy and inefficient. Presently, split system ACs are cleaned manually using the following or similar steps: clearing an area around the unit; taping a plastic bag around the bottom of the unit; spraying the units internal parts with water or water and chemicals; allowing the soiled fluids and debris to drain into a waste bucket; and disposing of the bucket with fluids. These methods are time consuming and messy and can be expensive. More often than not, these methods results in the adjacent wall and/or floor below the unit and bag becoming soiled, requiring additional clean up.

One object of the instant invention is to devise a method of cleaning split ACs or mini-split system AC units that is fast, efficient, consumes less effort and is less likely to soil adjacent areas compared with currently available methods for cleaning split system ACs.

A further object of the instant invention is to provide apparatus that facilitate the cleaning of split AC units by allowing the units to be cleaned more quickly, with less effort, and less mess.

There are limited prior art apparatus specifically designed to facilitate the cleaning of split system ACs. For the most part such apparatus comprise plastic bags or other drainage means and/or receptacles adopted to fit below the AC unit during cleaning. While such apparatus modestly improve upon the taped plastic bag method described above, they may not in all circumstances be efficient or friendly to use and, in particular, fail to protect the wall behind the unit from becoming damp and soiled.

A further object of the instant invention is to provide apparatus for cleaning split system ACs that protect the wall behind the unit from becoming damp or soiled during the cleaning process.

Yet a further object of the instant invention is to provide apparatus for cleaning split system AC units that do not require emptying bags or other receptacle that are mounted below the AC unit during the cleaning process.

Still another object of the subject invention is to provide a kit comprising apparatus used for cleaning slit system AC.

SUMMARY OF THE INVENTION

These and other objects are accomplished in the present invention, apparatus for cleaning split system and mini-split system air conditioning units and methods for cleaning the units that employ the apparatus.

The apparatus is comprised of a flat dry shield, a drain pan that interconnects with the bottom of the dry shield to form a watertight seal, releasable support means for supporting the drain pan to the underside of the dry shield, a drain hose and bucket or other receptacle to collect wastewater.

The dry shield is mounted between the wall and the indoor AC unit during the unit's initiation installation. The drain pan is releasably attached to the bottom of the shield and held in place using the support means during AC cleaning, and then removed after cleaning.

One end of the drain hose is attached to an drain outlet on the underside of the drain pan. The opposite end of the drain hose is inserted into a bucket or other suitable receptacle for collecting wastewater.

According to one embodiment, the dry shield is grooved along some or all edges. The groove along the bottom shield edge receives the drain pan while the groove along the side and/or top edges receives the supporting means.

According to another embodiment, the dry shield is grooved along its bottom and lower side portions and the drain pan is received into the groove and removeably attached to the bottom of the dry shield by pins inserted through holes formed on either side of the top edge of the drain pan and lower side edges of the dry shield.

According to the method of the instant invention, AC units which have been mounted with dry shields sandwiched between the units and wall are cleaned in accordance with the following or equivalent steps: (1) releasably attaching the drain pan to the bottom of the dry shield to form a water tight connection between the dry shield and drain pan, with support means attached to support the drain pan on the dry shield; (2) connecting the drain hose from the bottom of the drain pan to a bucket or other container; (3) spraying water and chemicals into the AC unit, which liquids drain together with debris into the drain pan, through the drain hose, and collect in the bucket; (4) emptying the bucket containing wastewater and debris; (5) removing the hose from the drain pan and the drain pan from the dry shield.

The dry shield is configured to mirror the size and shape of the back of the split AC unit that will employ it, but slightly larger so to extend out from behind the unit on all sides. The shield is thin and flat so as not to result in a bulking appearance. A hole is formed in the shield to accommodate the electric wires, RAC piping and condensate hose running between the inside unit and the outside AC units. This hole is typically drilled on site to correspond to a whole drilled into the wall positioned to address both the AC unit design and the stud configuration of the wall where the unit is mounted.

An AC mounting plate supplied with the commercial AC unit is fitted and secured over the dry shield. After leveling the dry shield and mounting plate together, and aligning the hole in the dry shield with the hole in the wall that will accommodate electric wires, RAC piping and condensate hose, the dry shield and mounting plate are secured to the wall by screwing first through the AC mounting plate, then through the dry shield, then through the wall, and finally into the wall stud. The AC mounting plate has brackets on its AC facing side to receive and secure the AC unit.

The dry shield holds the AC unit slightly out or away from the wall. This allows for easy insertion and fitting of the drain pan onto the bottom of the dry shield to form a water tight seal. The dry shield forms a moisture and dirt barrier, protecting the wall from becoming damp or soiled during the cleaning process.

The dry shield can be made from plastic, resins, plexiglass or other materials that are drillable, cut-able, UV resistant and/or deterioration proof. Because it is sized to be slightly larger than the AC unit, in addition to its other uses, it facilitates mounting the AC unit on the wall by extending over wall studs that might otherwise be beyond the width of the AC unit itself.

The drain pan is preferably constructed of light materials such as aluminum or plastic. The drain pan is shaped to extend the full width of the bottom of the dry shield and a little beyond, with its top edge contoured to extend up along the sides into the bottom portion of the dry shield's side grooves.

A nipple formed on the bottom of the drain pan receives a hose that drains waste water into a bucket or other receptacle. The hose would typically be made of flexible plastic and could be clear plastic to reveal the flow of liquid therein.

During cleaning, wastewater drains constantly from the AC unit, into the drain pan, through the hose and into the bucket or other receptacle. The bucket is emptied whenever the liquid level reaches a certain height. In this manner, liquid and moisture never reach the wall behind the unit or the floor below the unit.

According to one embodiment, the drain pan is hung from and supported by the dry shield with a cincture or hangers that fit within the groove along the top and/or side portions of the dry shield.

According to another embodiment, a gasket, rubber coating, or o-ring is used within the groove along the bottom edge of the shield to form a water tight seal between the dry shield and drain pan.

According to a further embodiment, a plastic sheet with metal lip along its top is used in lieu of a drain pan. The metal lip is sized and shaped to fit snuggly within the groove running along the bottom and lower edges of the dry shield and is inserted into this groove to form a watertight seal between the shield and sheet, preventing areas behind and below the sheet from becoming damp or soiled. The plastic sheet, once secured within the dry shield groove, functions in place of the drain pan to funnel waste water flowing from below AC unit into the bucket waiting below. This embodiment finds particular use in cases where a window, shelf, or other obstruction directly below the AC unit prevents the mounting of a drain pan below the unit.

The dry shield and drain pan are manufactured in different sizes to accommodate differently sized split AC units. Because the size of commercially available split system AC units are known, the apparatus of the subject invention can be manufactured to fit all such commercially available units.

Dry shields, drain pans, hoses, buckets and supporting means, whether hangers, cinctures or connecting pins, can be sold together as a kit, or separately. Do it yourselfers can buy the kit when purchasing a new split system AC unit. Alternatively, for those with AC units already installed with a dry shield behind the unit, the kit will comprise just the drain pan, hose, bucket and support means, or perhaps the drain pan, support means and cleaning chemicals and brushes.

One aspect of the subject invention is an apparatus that is installed together with a split system AC to facilitate the cleaning of the AC unit and to protect the areas in the vicinity of the AC unit during cleaning.

Another aspect of the subject invention is an apparatus that is installed together with a split system AC to facilitate the cleaning of the AC unit, to protect the wall behind the AC unit during cleaning, and to facilitate the mounting of the AC unit to the wall.

A further aspect of the subject invention is to provide apparatus that allow split AC units to be cleaned more quickly with less effort and less mess than currently available cleaning apparatus and methods.

A further aspect of the instant invention is to provide a kit that can be used by owners and purchasers of split and mini-split system AC units to easily clean their own units without the need to retain an AC professional.

DETAILED DESCRIPTION OF THE INVENTION

Described in detail, with referenced to the attached drawings, are preferred embodiments of apparatus and method for cleaning split system and mini-split system air conditioning units comprising the subject invention.

Figure 1:
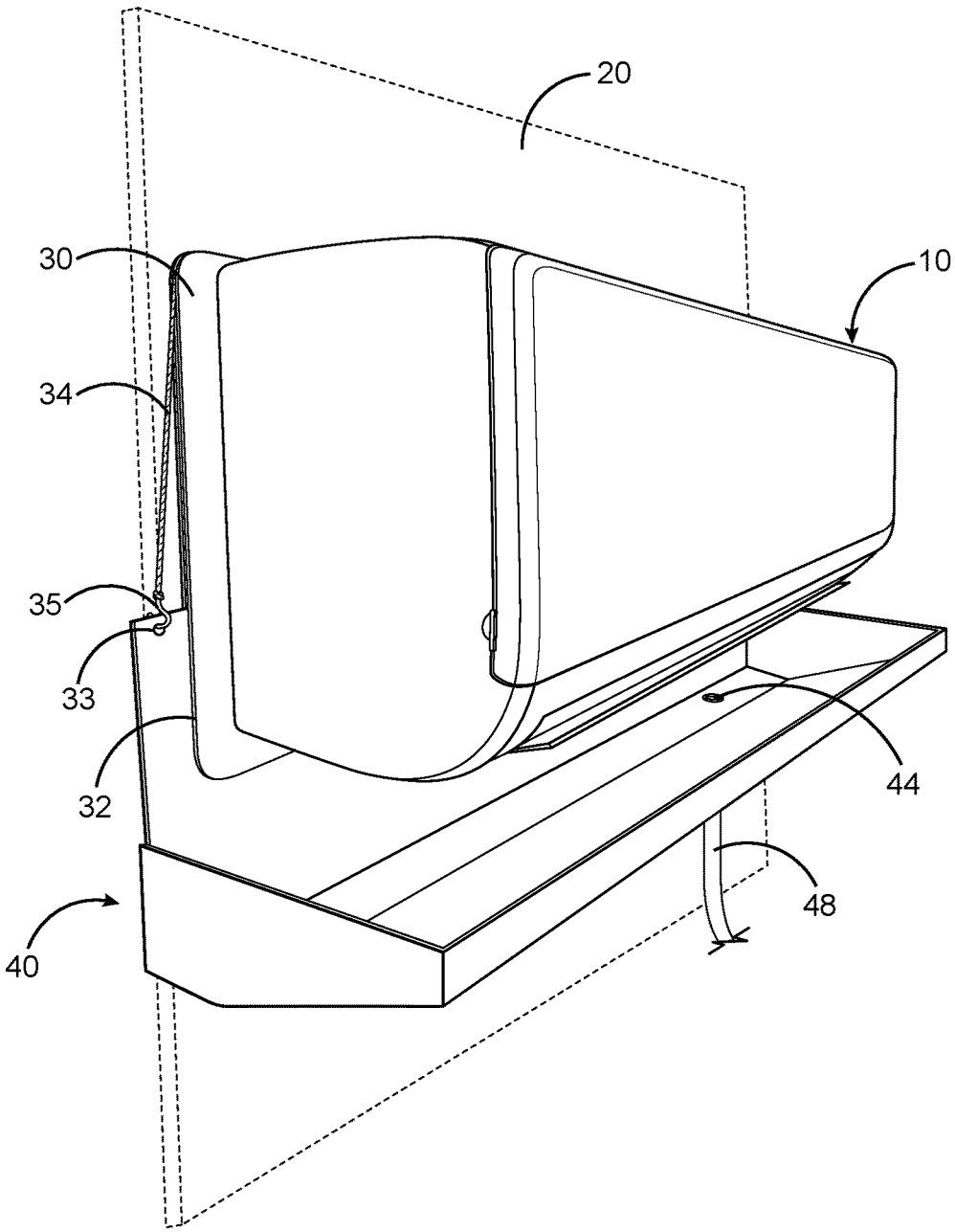
FIG. 1 is a perspective drawing of a mini split system AC unit employing the apparatus of the subject invention, taken from the top left.

Depicted in FIG. 1, a perspective view taken from the top left (when looking at the AC unit mounted on the wall), is a mini-split system air conditioner unit 10 mounted to a wall 20. A dry shield 30 lies between unit 10 and wall 20. A drain pan 40 is releasably attached to the bottom edge of shield 30 and supported by cincture 34 that lies within a groove 32 formed along the edge of shield 30. At the end of cincture 34 is a cincture hook 35 inserted into a cincture hook hole 33 formed within the top side of drain pan 40. Extending down from the bottom of drain pan 40 is a flexible drain hose 48.

Figure 2:
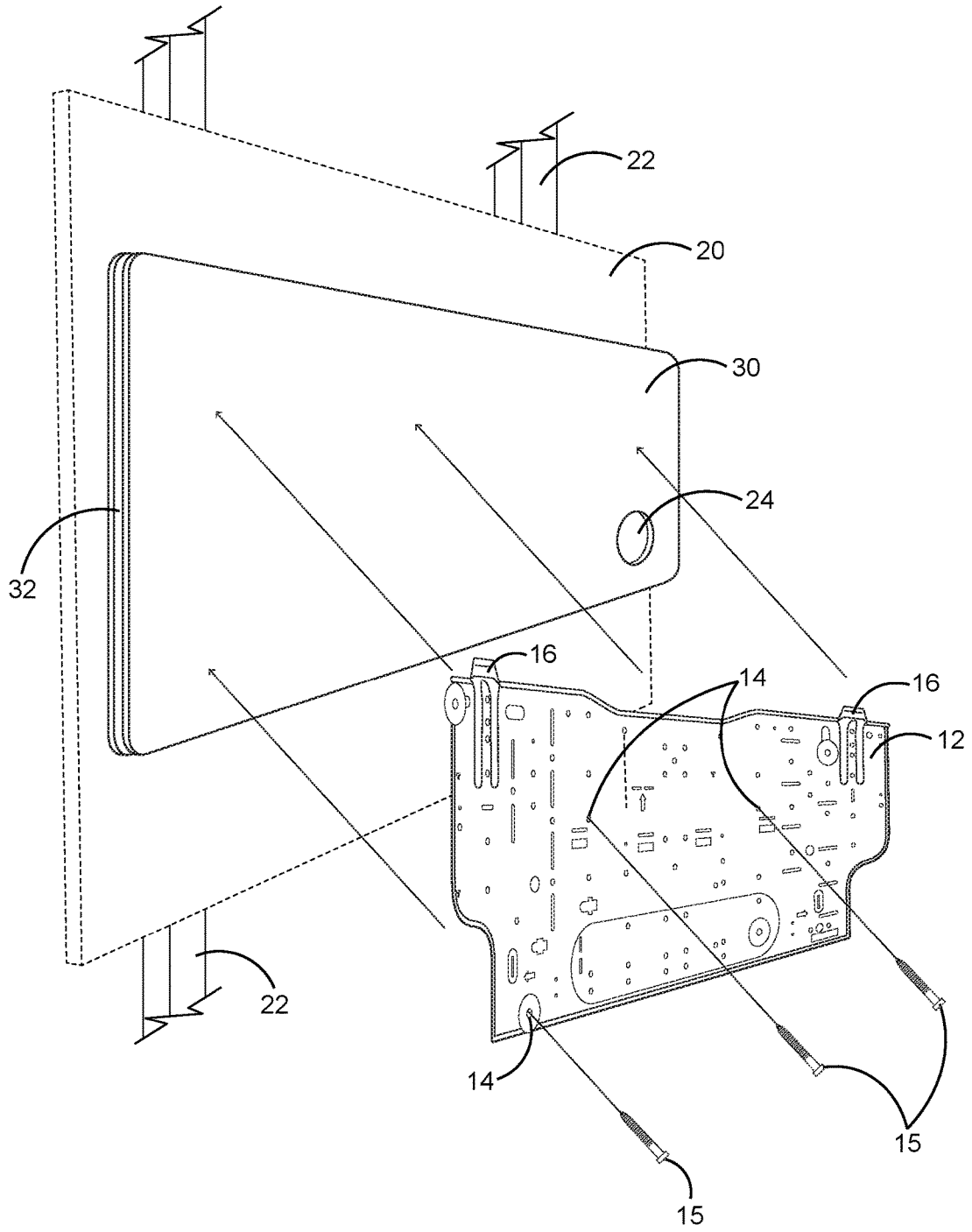
FIG. 2 is an exploded perspective view of the dry shield of the invention showing placement of an AC mounting plate on top of the dry shield and then on the wall in relation to wall studs.

Illustrated in FIG. 2 in exploded perspective view showing the placement and mounting of an AC mounting plate 12 atop dry shield 30 and wall 20. Dry shield 30 demonstrates a hole 24. Hole 24 would typically but cut on-site and positioned to align with hole in the wall that accommodates the electrical, refrigerant piping and condensate drain that runs from the inside AC unit to the outside AC unit.

Four screw holes 14 formed in mounting plate 12 receive a plurality of connectors, in this case screws 15, that connect mounting plate 12 to dry shield 30, wall 20 and a plurality of wall studs 22.

One method for mounting AC unit 10 with dry shield 30 backing to wall 20 and wall studs 22 is as follows. Dry shield 30 with hole 24 already formed is placed on a flat working surface. Mounting plate 12 is centered on top of shield 30 in the manner shown in FIG. 2. Mounting plate 12 is temporarily secured to dry shield 30 using a reversible fastening means such as double side tape, screws, or other small fasteners.

Next, dry shield 30 with mounting plate 12 affixed thereon is positioned on the wall with due regard for the wall studs and with hole 24 aligned with the wall hole (not shown), and leveled. Dry shield 30 with mounting plate 12 affixed is permanently secured to wall 20 by screwing through screw holes 14, into dry shield 30, into wall 20 and into wall studs 22 that support wall 20.

While the mounting plate 12 depicted in FIG. 2 demonstrates four screw holes 14, mounting plates 12 can come with more or less than four screw holes 14 (although generally, a minimum of four screws for securement of the inside AC unit would be desirable), and with screw holes 14 positions differently than shown in the mounting plate 12 shown in FIG. 2. Alternatively, or in addition, screws can be inserted through dry shield 30 external to mounting plate 12. This can be useful, in particular, where wall studs are only accessible behind that portion of dry shield 30 that extends beyond the outside edge of mounting plate 12.

Moreover, mounting plates 12 come in a variety of shapes and sizes depending upon the commercial AC unit to be mounted thereupon. Dry shield 30 will conform to the size and shape of mounting plate 12, always extended somewhat beyond the outside edge of mounting plate 12.

Once mounting plate 12 is mounted onto wall 20 over dry shield 30 and into wall studs 22, AC unit 10 is mounted on mounting plate 12 as shown in FIG. 1 using two mounting brackets 16 that extend out from mounting plate 12.

Figure 3A:
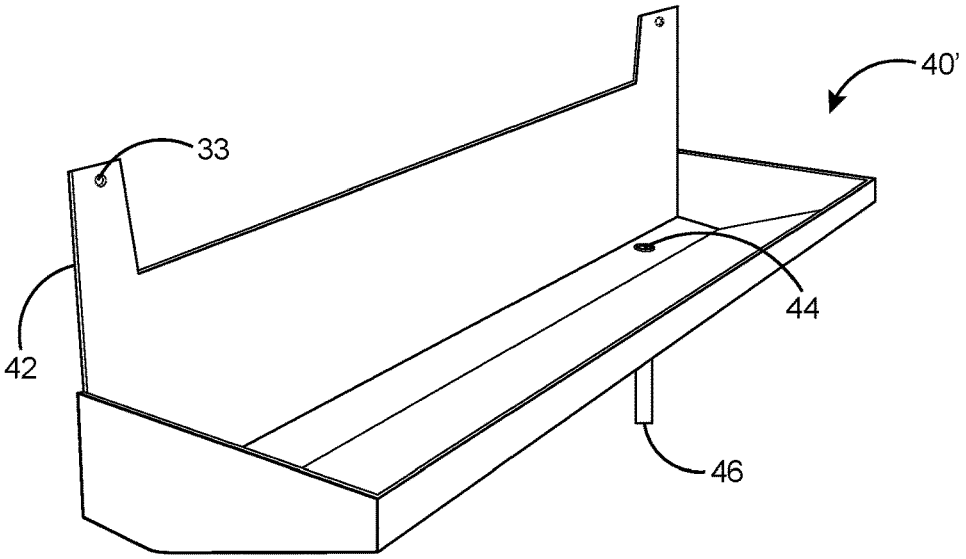
FIGS. 3A and 3B show two embodiments of the drain pan of the subject invention, FIG. 3A being a top left perspective view of a drain pan to be hung with a cincture or hanger, and FIG. 3B being a bottom right perspective view of a drain pan to be hung with support pins.
Figure 3B:
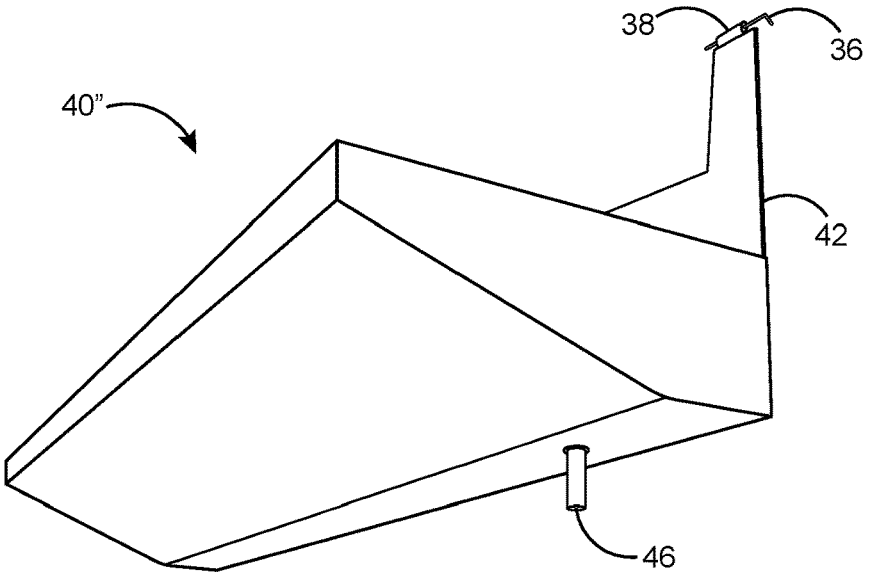
Figure 4:
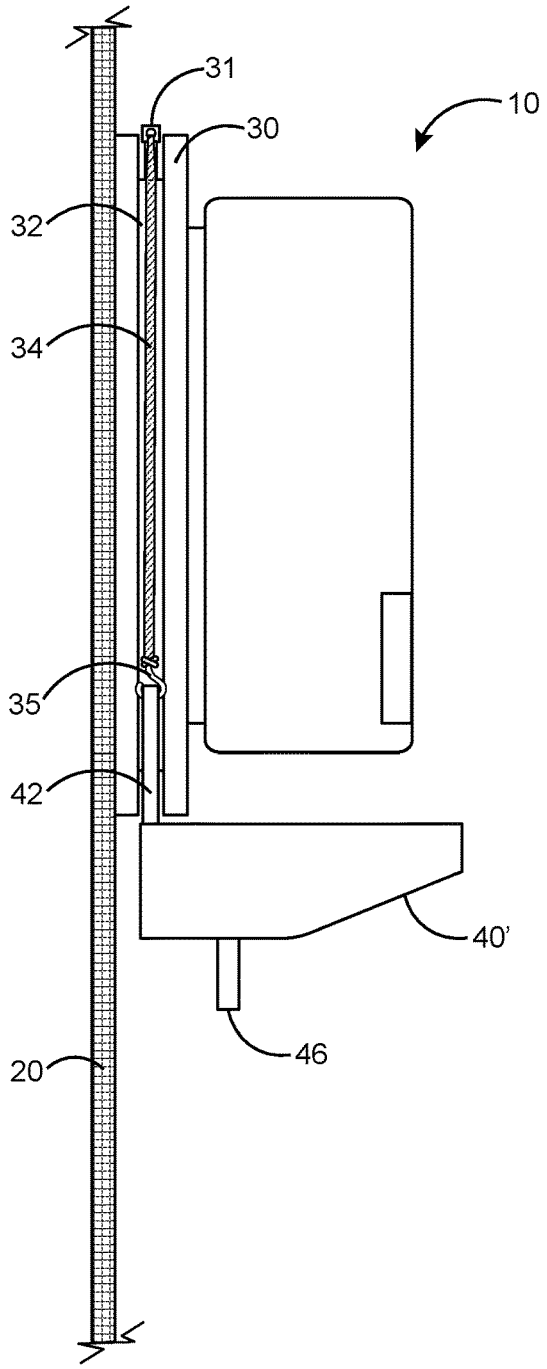
FIG. 4 is a left side plan view of a mini split system AC unit employing the apparatus of the subject invention, mounted on a wall, with the drain pan mounted on the bottom of the dry shield and held in place with a cincture.

Illustrated in FIGS. 3A and 3B are the details of one embodiment of drain pan 40, FIG. 3A being a top left perspective view of a drain pan 40' supported by a cincture or hander, and FIG. 3B being a bottom right perspective view of a drain pan 40" supported by support pins. Drain pan 40 has a back plate 42 contoured to fit snugly along the bottom groove of dry shield 30 (as illustrated in FIG. 4). The outside top edges of back plate 42 extend upwards to fit along the side grooves of the bottom portion of dry shield 30 (also illustrated in FIG. 4). A drain hole 44 is formed in the bottom of drain pan 40 with a drain nipple 46 extending downward from hole 44. Hose 48, as shown in FIG. 1 for example, attaches to nipple 46. Drain pan 40' also includes a cincture hook hole 33 formed on the top of each side to receive cincture hooks described below, while drain pan 40" has a pin casing 38 formed on the top of each side to receive support pins 36.

Depicted in FIG. 4, a left side (when facing the AC unit) plan view, is mini split system AC 10 unit employing the apparatus of the subject invention. Split system AC unit 10 is mounted on wall 20 with dry shield 30 sandwiched in between unit 10 and wall 20. According to the depicted embodiment, drain pan 40 is releasably attached to the bottom of shield 30 by inserting back plate 42 into groove 32 running along the bottom edge of shield 30 to form a water tight seal between the bottom of shield 30 and the top edge of back plate 42. The upper side edge (the left side seen in FIG. 4) of back plate 42 sits within the groove formed along the side edge (the left side edge seen in FIG. 4) of shield 30.

Still referring to FIG. 4, drain pan 40 is supported by cincture 34 that sits inside groove 32 along the top and side edges (the left side edge seen in FIG. 4) of shield 30. At the ends of cincture 34 are cincture hooks 35 that are inserted into cincture hook holes 33 formed at the top sides of back plate 42. A removeable cincture pin 31 holds the top of cincture in place along the top of groove 32 and would typically be in place during cleaning. Extending from the bottom of drain pan 40 is drain nipple 46 that will receive drain hose 48 (shown in FIG. 1).

Figure 5:
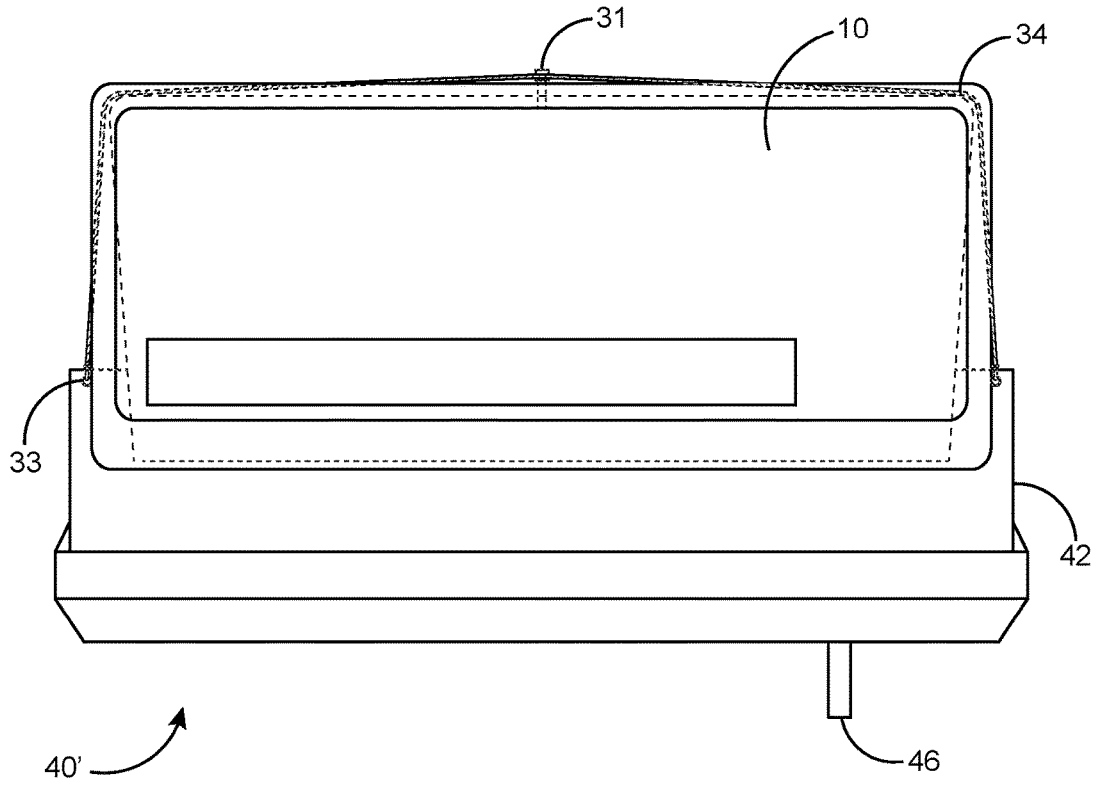
FIG. 5 is a front plan view of a mini split system AC unit employing the apparatus of the subject invention as shown in FIG. 4.

The embodiment of the AC cleaning apparatus of the subject invention depicted in FIG. 4 is illustrated from the front in FIG. 5. AC Unit 10 is affixed to and overlays dry shield 30. Drain pan 40 is releasably attached to the bottom of dry shield 30 with back plate 42 of shield 30 sitting inside groove 32 formed along the bottom and lower side edges of shield 30 to form a water tight seal. Drain pan 40 is supported by cincture 34 sitting within groove 32 and ending in cincture hooks 35 that are inserted into hook holes 33. Cincture pin 31 holds cincture 34 in place along groove 32. Drain nipple 46 extends from the bottom of drain pan 40 to receive drain hose 48 (as shown in FIG. 1).

Figure 6:
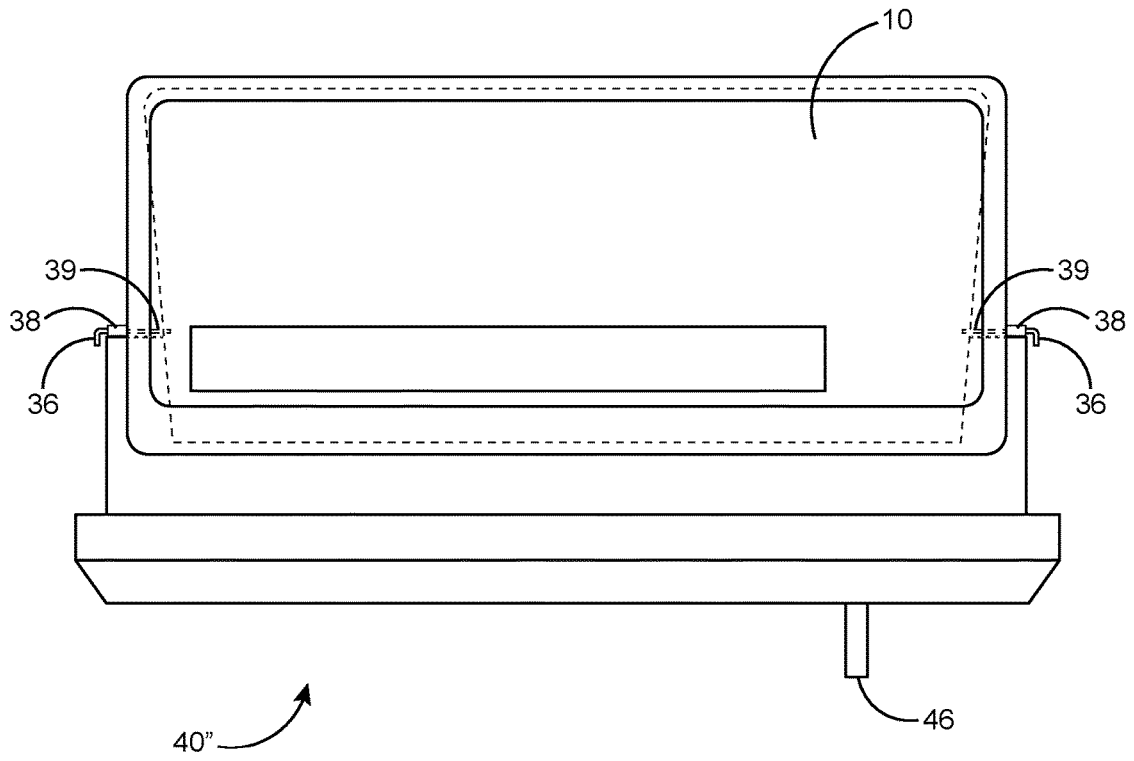
FIG. 6 is an front view a mini split system AC unit employing an alternative embodiment apparatus of the subject invention, wherein the supporting means for the drain pan comprise pins fitted through holes formed in the drain pan and dry shield.

Depicted in FIG. 6 is an alternative embodiment of the apparatus of the subject invention wherein drain pan 40 is supported on the bottom of dry shield 30 by two support pins 36 instead of cincture 34 in the embodiment shown in FIGS. 4 through 5. According to the embodiment depicted in FIG. 6, each support pin 36 is inserted through a support pin casing 38 formed in the upper side aspects of back plate 42 and a support pin hole 39 formed the lower side edges of dry shield 30. As with the first described embodiment, AC unit 10 sits atop dry shield 30 and drain nipple 46 extends down from the bottom of drain pan 40.

Figure 7:
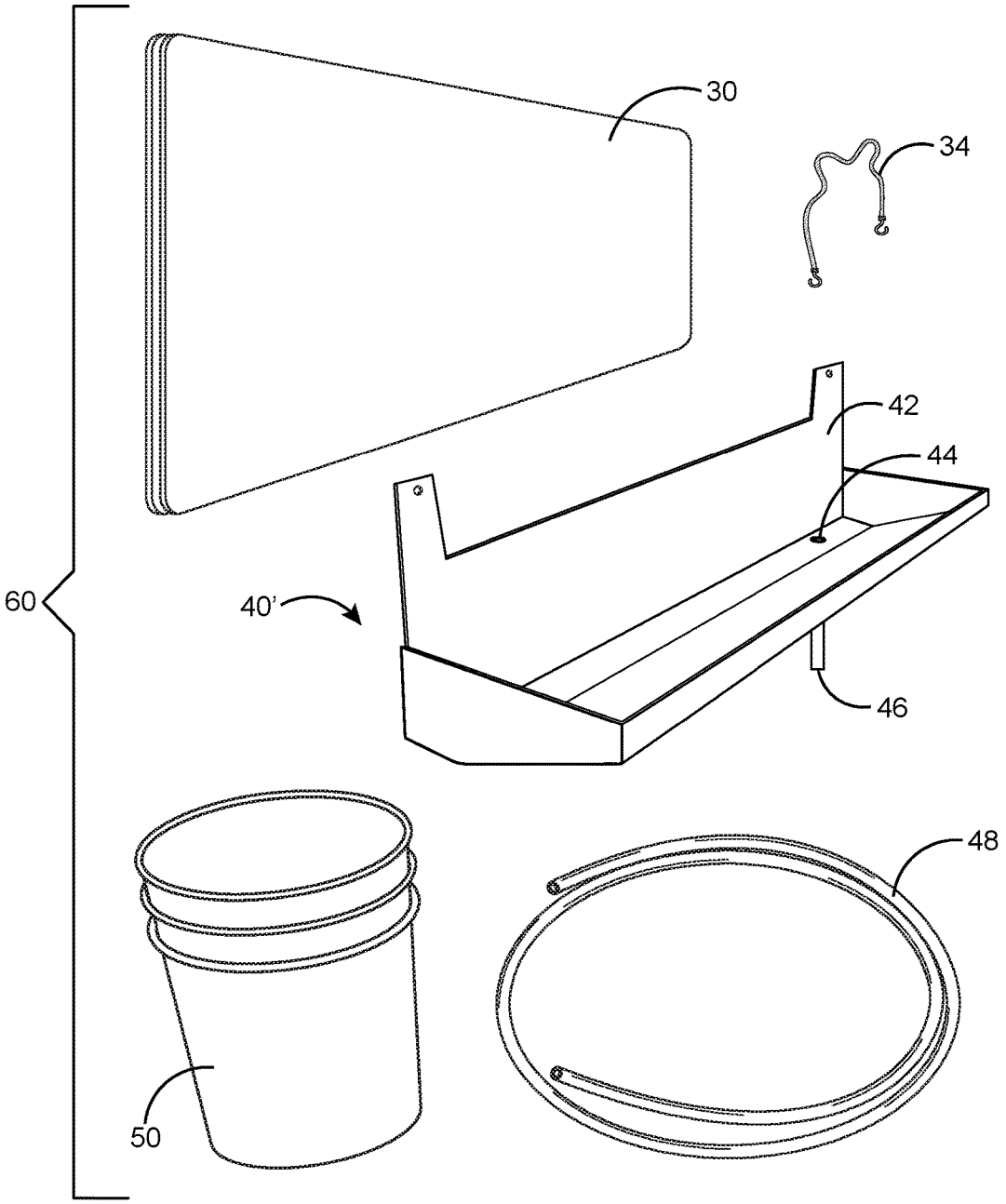
FIG. 7 shows the elements of a kit of the subject invention.

The elements of one embodiment of a kit 60 of the subject invention are illustrated in FIG. 7. According to this embodiment, kit 60 comprises dry shield 30 sized to fit the commercial AC unit to be mounted, drain pan 40, cincture 34, flexible hose 48, and bucket 50. Alternative embodiment kits may also contain support pins 36 instead of or in addition to cincture 34 and have drain pans 40 with cincture holes 33 and/or pin casings 38.

Figure 8:
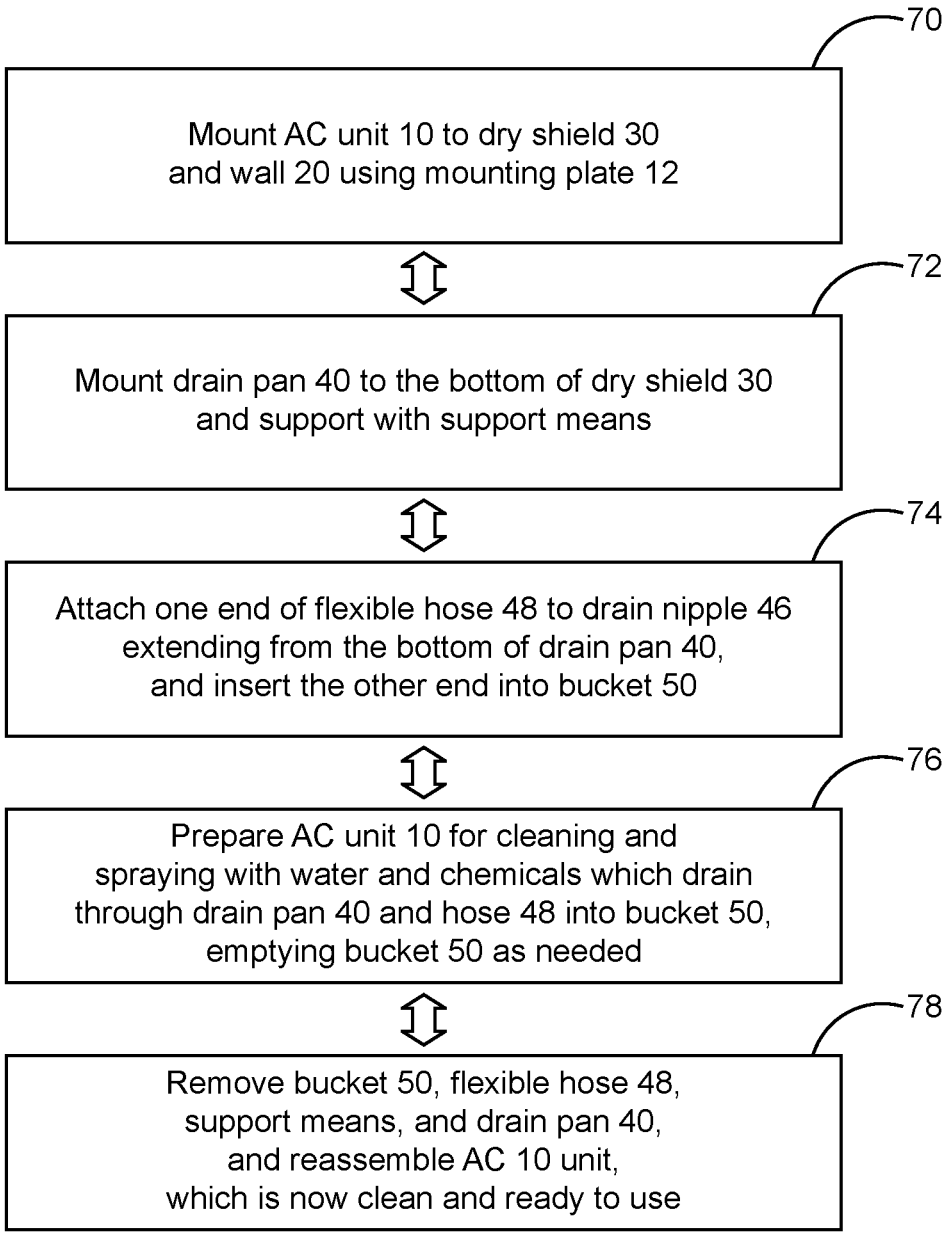
FIG. 8 is a schematic illustrating one embodiment of a method that employs the apparatus of the subject invention.

Illustrated in FIG. 8 in schematic format is one embodiment of the steps of the method of the subject invention employing the apparatus of the subject invention. According to the method shown, a step 70 comprises mounting AC unit 10 onto wall 20 with dry shield 30 sandwiched in between. As earlier explained, step 70 details include drilling hole 24 in dry shield 30 to align with the hole drilled in wall 20; temporarily attaching AC mounting plate 12 to dry shield 30 positioned such that dry shield 30 extends out from the edges of plate 12 in all directions; aligning, leveling and permanently attached plate 12 and dry shield 30 onto wall 20 using studs 22 behind wall 20; and mounting AC unit 10 onto mounting plate 12.

Optional detail for installation step 70 can be described as follows:

- dry shield 30 is placed flat upon a suitable, level work surface making sure the top is away from you;
- AC mounting plate 12 is positioned on top of dry shield 30;
- AC mounting plate 12 is then centered, leveled and secured to the desired position on the dry shield 30 with short screws or two way tape;
- after joining AC mounting plate 12 to dry shield 30, hole 24 to route the electrical line, RAC piping and condensation hose is measured and drilled in dry shield 30 using the correct sized hole saw;
- the entire assembly is now ready to be installed on the wall space and is centered and leveled on the wall;
- multiple screws 15 are used to secure the assembly to the wall;
- screws 15 penetrate AC mounting plate 12 first, then through dry shield 30, through the drywall and finally wooden wall studs 22;
- once the assembly is leveled and secured, a hole through the drywall and the outdoor wall panel can be made using the same size hole saw used for dry shield 30;
- after the hole through the wall is completed, indoor AC unit 10 is positioned and mounted like a standard installation;
- the remaining parts of the AC system can then be installed as usual.

To prepare for cleaning of AC unit 10, a further step 72 comprises mounting drain pan 40 onto the bottom of dry shield 30 by inserting the top of drain pan back plate 42 into groove 32 formed along the bottom edge of shield 30, and implementing a support means. The support means could be cincture 34 placed within the top and side aspects of groove 32 and thereafter attached to the top side edges of back plate 42 using cincture hooks 35; or insertion of support pins 36 through support pin casings 38. Once drain pan 40 is mounted and supported, a water tight seal is formed between dry shield 30 and drain pan 40.

A further step 74 comprises attaching one end of flexible hose 48 to drain nipple 46 extending from the bottom of drain pan 40, and inserting the other end of flexible hose 48 into bucket 50.

A further step 76 comprises disassembling AC unit 10 mounted on wall 20, and spraying water and cleaning fluids into AC unit 10 to clean the heat exchanger and other internal parts of AC unit 10. The waste water, containing chemicals and debris, drains through the AC unit to drain pan 40 without soiling wall 20 or the area below AC unit 10. The waste water flows out of drain pan 40 through drain hole 44 and drain nipple 46 into flexible hose 48 and finally collects in bucket 50. When the waste water reaches a certain height, bucket 50 is emptied in an environmentally responsible manner. Bucket 50 is re-positioned below AC unit 10 with the free end of flexible hose 48 again inserted inside and the process continues until AC unit 10 is fully clean.

A further step 78 comprises removing and emptying bucket 50, removing flexible hose 48 from drain nipple 46, removing the support means that supports drain pan 40 to the bottom of dry shield 30, and removing drain pan 40 from dry shield 30. Finally, AC 10 unit is re-assembled and, once allowed to fully dry, ready to use.

Optional detail for the servicing steps, 72 through 78, can be described as follows:

- once the servicing of AC unit 10 is warranted, turn off all electrical power to AC unit 10;
- check to be sure all power is disconnected;
- cover the working floor area with a large protective plastic or tarp;
- insert drain pan 40 into position on dry shield 30;
- secure drain pan 40 to dry shield 30 using a securement means such as pins 36 or cincture 34;
- securely attach clear drain hose 48 to nipple 46 extending down from the bottom of drain pan 40; route the other end of drain hose 48 to a suitable bucket or other receptacle 50;
- wastewater will constantly be collected into bucket 50 during the servicing procedure and indoor unit 10 can now be prepped by partial disassembly for cleaning;
- water and chemicals are sprayed into the AC units fan assembly, coil and drain pan;
- specially made long thin nozzles can be used to reach into tight locations;
- dry shield 30 protects the wall behind unit 10 from moisture and dirt during servicing;
- as water and chemicals are sprayed into unit 10, contaminants will be constantly flowing into drain pan 40, through nipple down 46 down drain hose 48, and collecting in bucket or receptacle 50;
- bucket 50 is then emptied when needed;
- after the system is cleaned it can be air dried with a hand held hair dryer or air dried;
- once drying is completed, drain pan 40, hose 48 and bucket 50 can be disconnected and removed leaving the dry shield 30 in place;
- AC unit 10 can then be reassembled and tested.

As will be appreciated by those engaged in the cleaning of split system AC units, the method steps set forth above can be varied to a considerable degree and still obtain the desired result. By way of example and not limitation, flexible hose 48 can be attached to the underside of drain pan 40 before drain pan 40 is releasably attached to dry shield 30. Similarly, after cleaning, drain pan 40 can be removed from dry shield 30 before hose 48 is removed from drain nipple 46. These and other variations in the described method are within the contemplated scope of the subject invention.

SUMMARY AND SCOPE

As may be appreciated from the above description and accompanying drawings, the apparatus and method of the subject invention cuts the time for a professional to clean a split-AC unit from approximately 2 hours to as little as a half hour. In addition, there is less clean-up and less chance that the adjacent wall or floor area will be soiled.

The apparatus and method promotes the cleaning of split system and min-split system AC unit by owners without the need to retain a professional AC service person.

The dry shield component of the apparatus of the instant invention provides a moisture barrier between the AC unit and the wall behind the AC unit.

The dry shield component of the apparatus facilitates mounting of the AC unit to wall studs behind the wall.

In kit form, the invention provides the AC owner the AC professional with convenience of a one stop shopping for equipment needed to quickly and neatly clean split system and mini split system AC units.

Unless otherwise indicated, all numbers, dimensions, materials and so forth used in the specification and claims are to be understood as being examples and not limitations, and in any event, not as an attempt to limit the application of the doctrine of equivalents to the scope of the claims.

The terms "a," "an," "the," and similar references used in the context of describing the invention (especially in the context of the following claims) are to be construed to cover both the singular and the plural, unless otherwise indicated herein or clearly contradicted by context. All methods described herein can be performed in any suitable order unless otherwise indicated herein or otherwise clearly contradicted by context. The use of any and all examples, or exemplary language (e.g., "such as") provided herein is intended merely to better illuminate the invention and does not pose a limitation on the scope of any claim. No language in the specification should be construed as indicating any non-claimed element essential to the practice of the invention.

Certain embodiments are described herein, including the best mode known to the inventor for carrying out the invention. Of course, variations on these described embodiments will become apparent to those of ordinary skill in the art upon reading the foregoing description. The inventor expects skilled artisans to employ such variations as appropriate, and the inventors intend for the invention to be practiced otherwise than specifically described herein.

By way of example and not limitation, the embodiment of the drain pan described and illustrated herein can be varied without departing from the spirit and scope of the invention. A variety of support means can be utilized to support the drain pan on the dry shield in addition to the cincture, hangers and support pins described herein. The drain pan can have more than one drain and the drain hole can be formed in the bottom side rather than the bottom of the drain pan. Other similar variations in the apparatus and method of the invention will be obvious to those engaged in the art.

Accordingly, the claims include all modifications and equivalents of the subject matter recited in the claims as permitted by applicable law. Moreover, any combination of the above-described elements in all possible variations thereof is contemplated unless otherwise indicated herein or otherwise clearly contradicted by context. The invention should therefore not be limited by the above described embodiment, method, and examples, but shall be deemed to include all embodiments, methods and equivalents within the scope and spirit of the invention as claimed.

The invention claimed is:

1. A system for cleaning split system air conditioner indoor units comprising:

a split system air conditioner indoor unit;

a continuous flat impermeable shield sized to fit behind said indoor unit and extend out from all sides thereof;

an interior wall of an enclosed structure;

wherein said interior unit is mounted to said interior wall with said flat shield sandwiched between said indoor unit and said interior wall; and wherein said shield forms an impermeable barrier between the indoor unit and the wall, protecting the wall from dirt and moisture during cleaning.

2. The system of claim 1, further comprising a drain pan having a width at least equal to the width of the bottom of said shield that is detachably interconnected along the bottom of said shield to form a water tight seal between said shield and said drain pan to collect effluents during cleaning.

3. The system of claim 2 further comprising a support means to support said drain pan on said shield while said drain pan is interconnected with said shield during cleaning of said air conditioner indoor unit.

4. The system of claim 3 wherein said support means comprise pins that are inserted through holes formed in the top side edges of said drain pan and bottom side edges of said shield.

5. The system of claim 3 wherein said support means comprise a cincture that encircles the top and sides of said shield and attaches to the top side edges of said drain pan.

6. The system of claim 5 wherein a groove is formed along all edges of said shield, which groove receives the support cincture along the shield's top edge and upper side edges, while receiving the back top portion of said drain pan along its bottom and lower side edges to form a watertight seal between said shield and said drain pan.

7. The system of claim 3 wherein said support means comprise hangers that extend from the top sides of said shield and attach to the top side edges of said drain pan.

8. The system of claim 2 further comprising a hole with nipple formed in the bottom of said drain pan and a flexible hose that attaches to said nipple and extends downwards therefrom.

9. The system of claim 2 further comprising a receptacle into which the free end of said flexible hose is inserted, said receptacle positioned beneath said unit and drain pan to collect water and debris during cleaning of the air conditional unit.

10. The system of claim 2 wherein a groove is formed at least along the bottom edge of said shield which groove receives the back top portion of said drain pan to form a watertight seal between said shield and said drain pan.

11. The system of claim 10 further comprising placing within said groove material selected from the group consisting of o-rings, rubber coating, and gaskets, prior to the insertion of the drain pan into said groove, to form a watertight seal between said shield and said drain pan.

12. The system of claim 2 wherein a groove is formed at least along the bottom and lower aspects of the side edges of said shield which groove receives the back top portion of said drain pan to form a watertight seal between said shield and said drain pan.

13. The system of claim 1, wherein the shield is fabricated of material selection from the group comprising plastic, resins, or plexi-glass.

14. A method for cleaning split system air conditioner indoor units installed on interior walls of enclosed structures comprising the steps of:

(a) providing a system comprising:

a split system air conditioner indoor unit;

a continuous flat impermeable shield sized to fit behind said indoor unit and extend out from all sides thereof;

an interior wall of said enclosed structure;

wherein said interior unit is mounted to said interior wall with said flat shield sandwiched between said indoor unit and said interior wall; and (b) cleaning said unit by spraying liquids and cleaning fluids into the internal components of said air conditioning.

15. The method of claim 14 further comprising the step of drilling a hole in said flat shield prior to installing said shield between said air conditioning unit and said wall and aligning said hole in said shield with a hole formed in the wall.

16. The method of claim 14, wherein in step (b) a plastic sheet is secured to the bottom edge of said shield in place of said drain pan to form a water tight seal between said shield and said plastic sheet and wherein the liquids and fluids are collected by and disposed of from said sheet.

17. The method of claim 14 wherein the system further comprises a drain pan having a width at least equal to the width of the bottom of said shield that is detachably interconnected along the bottom of said shield to form a water tight seal between said shield, and wherein the method further comprises (c) collecting said liquids and fluids in said drain pan, (d) removing said drain pan from said shield, and (e) disposing of the liquids and fluids from said drain pan.

18. The method of claim 17, further comprising a drain hole formed in the bottom of the drain pan and a receptacle placed below said drain hole and wherein said liquids and fluids draining into the drain pan drain further through the hole into and are collected by the receptacle and, later, disposed of fluid from the receptacle.

19. The method of claim 18, further comprising a nipple extending down from said drain hole and a flexible tubing one end of which is inserted over said nipple and the other end of which is inserted into the receptacle, and wherein liquids and fluids draining into the drain pan drain further through the drain hole and flexible tubing into and are collected by the receptacle and, later, disposed of from the receptacle.

* * * * *